United States Patent [19]

Roznieckí

[11] Patent Number: 4,476,937

[45] Date of Patent: Oct. 16, 1984

[54] RAPID ACTING TWO STAGE PYROTECHNIC VALVE FOR FIXED FIRE EXTINGUISHERS

[75] Inventor: Edward J. Roznieckí, Macomb County, Mich.

[73] Assignee: The United States of America as represented by the Secretary of the Army, Washington, D.C.

[21] Appl. No.: 433,571

[22] Filed: Oct. 8, 1982

[51] Int. Cl.[3] ..... A62C 35/02

[52] U.S. Cl. ..... 169/26

[58] Field of Search ..... 169/20, 26, 28, 60, 169/22; 137/68 A, 70, 71; 251/44

[56] References Cited

U.S. PATENT DOCUMENTS

| | | | |
|---|---|---|---|
| 1,945,715 | 1/1931 | Wiswell | 137/68 R |
| 2,799,466 | 7/1957 | Hickerson | 251/44 X |
| 3,905,575 | 9/1975 | Zeuner et al. | 251/44 X |
| 4,046,156 | 9/1977 | Cook | 137/68 A |
| 4,090,688 | 5/1978 | Workman | 251/44 X |
| 4,245,660 | 1/1981 | Roznieckí | 137/68 A |

FOREIGN PATENT DOCUMENTS 1050201 1/1952 Fed. Rep. of Germany .

*Primary Examiner*—John J. Love
*Assistant Examiner*—Kevin Patrick Weldon
*Attorney, Agent, or Firm*—Peter A. Taucher; John E. McRae; Robert P. Gibson

[57] ABSTRACT

A pilot-actuated valve for controlling outflow of pressurized fire-suppressant fluid from a thick-walled container. The valve includes a stepped piston that is disposed in an internally stepped housing. To effect a discharge cycle an annular pressurizable chamber is vented to reduce the pressure on one face of the piston, thereby enabling unbalanced pressure forces to rapidly move the piston toward a flow-control diaphragm; an annular cutter on the leading end of the piston ruptures the diaphragm to permit outflow of pressurized fire suppressant. The valve is characterized by leak-free operation during standby periods, and rapid fluid discharge during the actuation cycle.

10 Claims, 6 Drawing Figures

RAPID ACTING TWO STAGE PYROTECHNIC VALVE FOR FIXED FIRE EXTINGUISHERS

GOVERNMENT INTEREST

The invention described herein may be manufactured, used, and licensed by or for the Government for governmental purposes without payment to me of any royalty thereon.

BACKGROUND AND SUMMARY

This invention relates to rapid-acting fire suppressant valves that utilize rupturable diaphragms to control outflow of pressurized suppressant from thick-walled containers (bottles). Valves of this general type are shown in U.S. Pat. No. 3,491,783 to O. Linsalato, U.S. Pat. No. 3,762,479 to L. Fike et al., and U.S. Pat. No. 3,915,237 to E. Ronzniecki (the present inventor). General objects of my present invention are to provide a rupturable diaphragm valve that has a fast response time, that has a large flow area, that is of leak-free character during standby periods, and that includes means for trapping flames and combustion products generated by a squib actuator used to rupture the diaphragm. A particular object is to provide mechanism for safely handling diaphragm fragments that could produce personnel injuries if allowed to flow with the fire suppressant jet stream. In my design both the squib-actuator flame and diaphragm fragments are kept out of the suppressant jet stream path.

THE DRAWINGS

FIG. 1 is a sectional view taken through a valve embodying my invention.

FIGS. 2 and 3 are transverse sectional views taken on lines 2—2 and 3—3 in FIG. 1.

Figure 6:
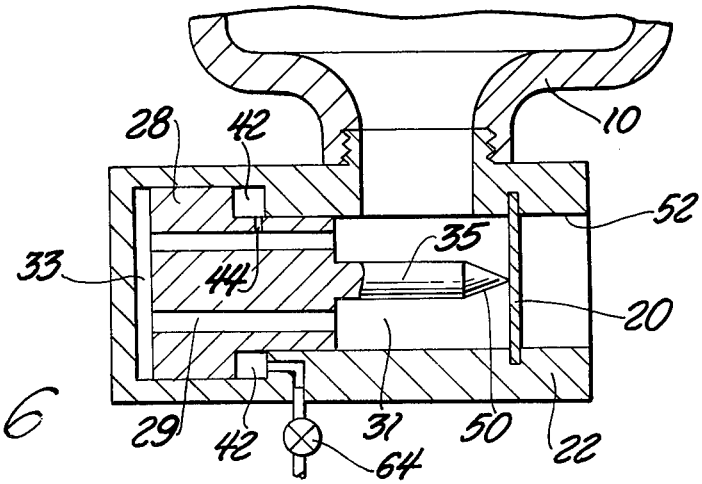

FIG. 6 schematically illustrates the mode of operation of my invention.

Referring first to FIG. 6 for a general understanding of the invention, there is fragmentarily shown a fire suppressant bottle 10 pressurized with bromotrifluoromethane ($CF_3Br$) to about 750 p.s.i. The pressurized fluid is supplied to a valve housing 22 that contains a rupturable diaphragm 20 and movable stepped piston 28. Internal passages 29 within the piston conduct fluid from chamber 31 to another chamber 33 at the left end face of the piston. A small orifice 44 fills annular chamber 42 with pressurized fluid. The piston includes a rod 35 having a sharpened end 50 in close proximity to diaphragm 20. A vent valve 64 normally maintains chamber 42 in a pressurized condition.

Assuming valve 64 to be closed, the fluid pressure forces on piston 28 will be balanced; the piston will remain in its illustrated position, with diaphragm 20 acting to contain the fluid pressure against outflow through discharge opening 52. Should valve 64 now be opened chamber 42 pressure will be vented to the atmosphere. The force due to pressure in chamber 33 will now be substantially greater than the force due to pressure in chamber 31 because of the difference in face areas at the respective ends of the piston. Accordingly the piston will move to the right, causing the shapened end 50 of rod 35 to rupture diaphragm 20. Fluid pressure in chamber 31 will completely tear the ruptured diaphragm to permit full fluid flow through opening 52 toward the emergent fireball.

Figure 1:
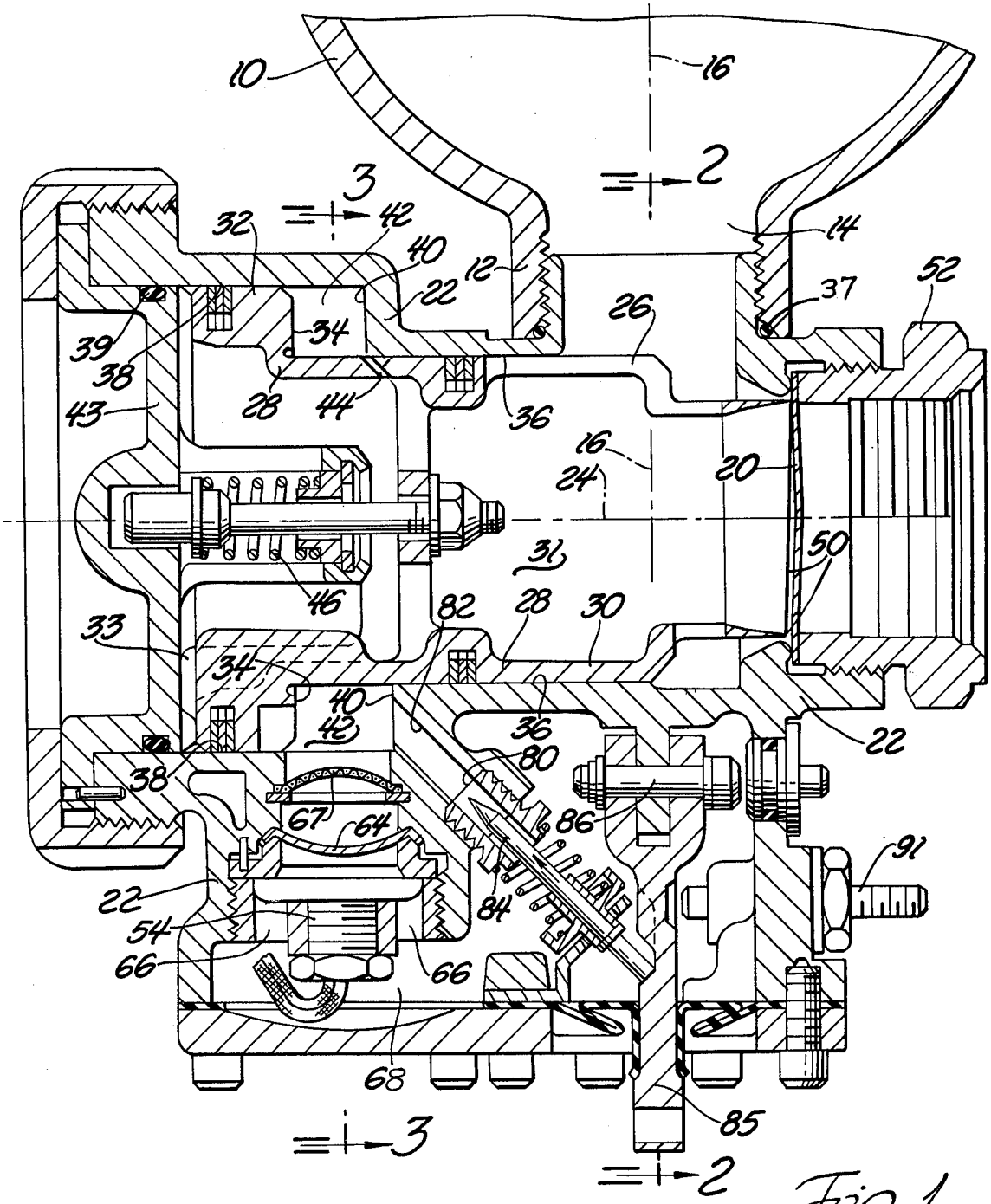
Figure 2:
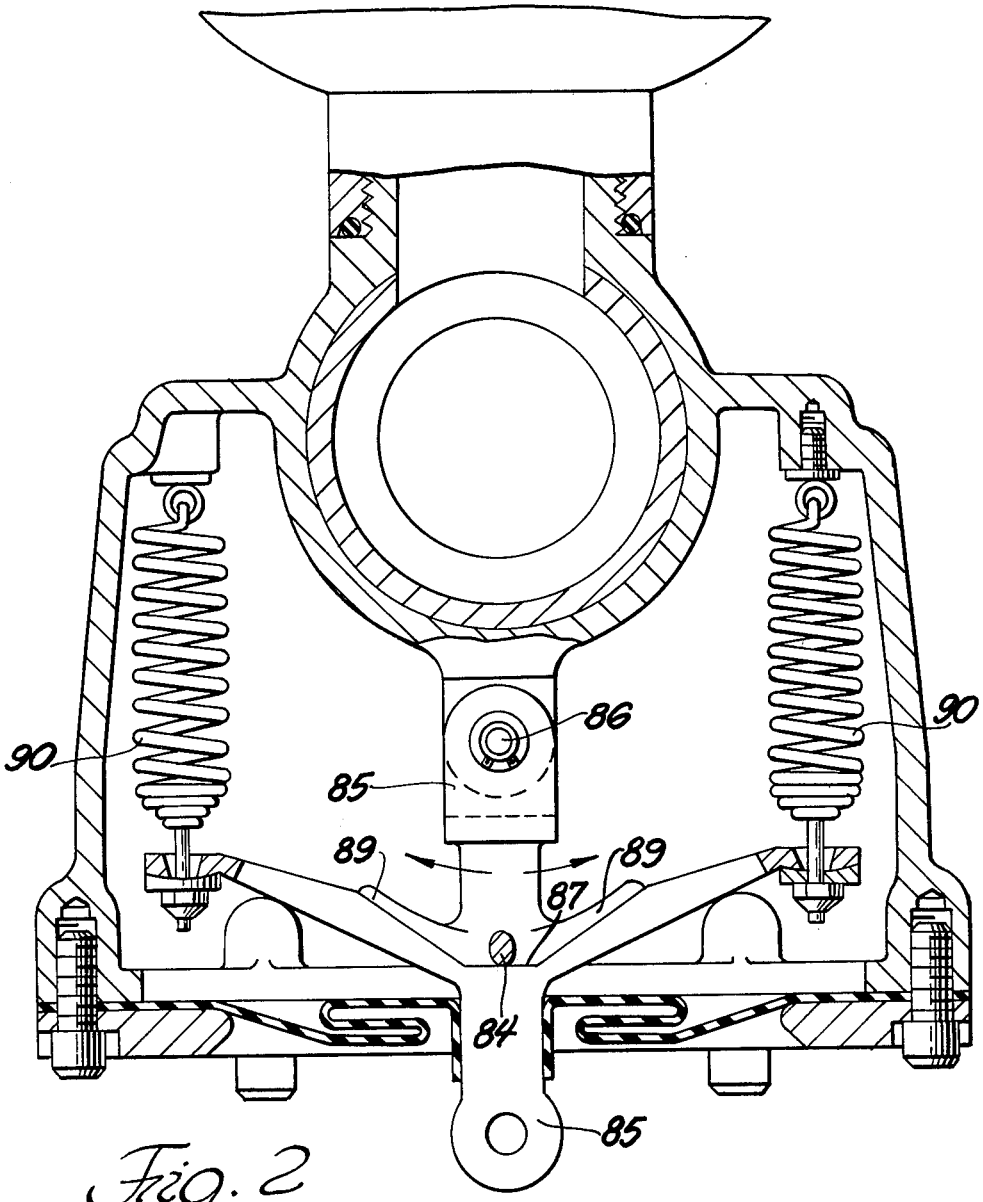
Figure 3:
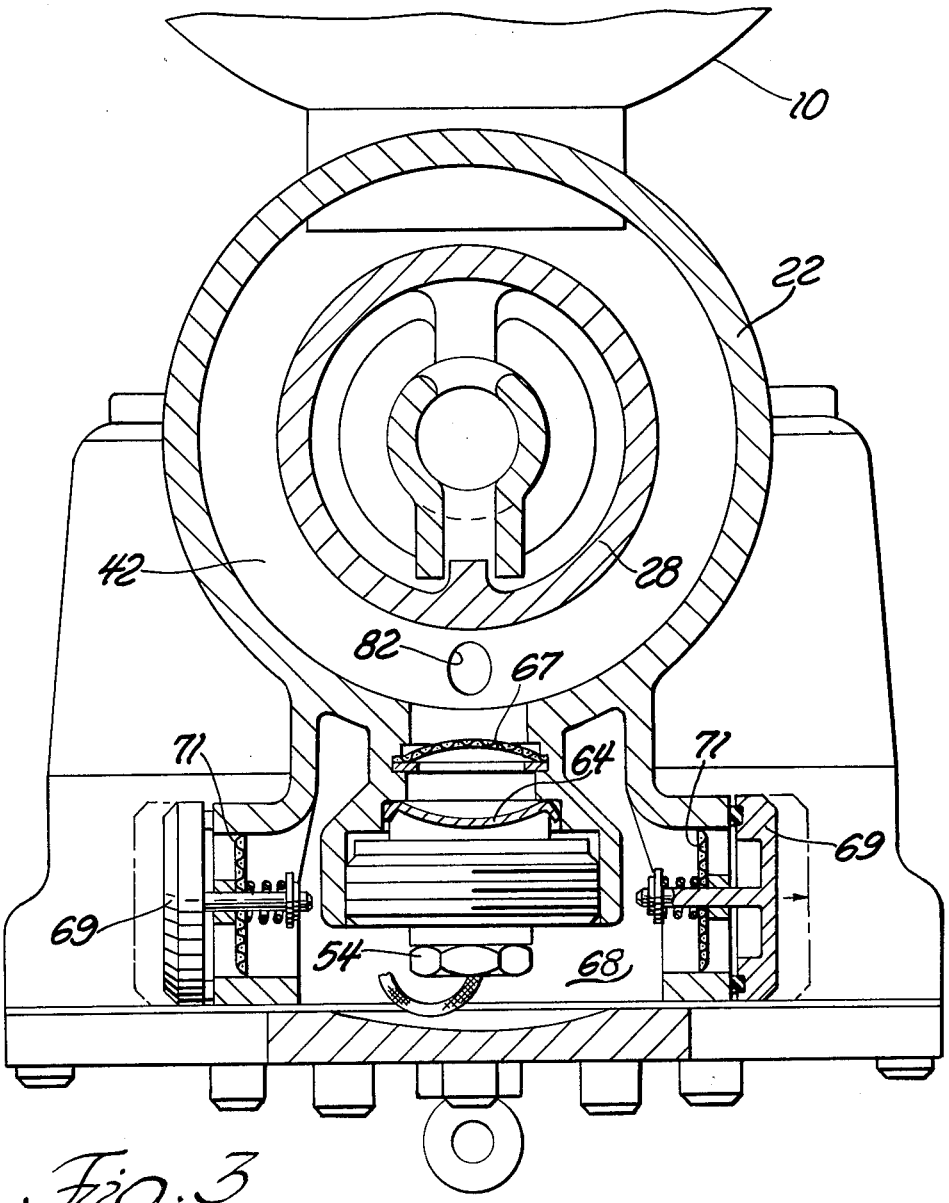

The basic concept of the invention is to utilize a relatively small vent valve 64 to unleash a differential force of relatively great magnitude on the left end of the opeating piston 28. The primary objective is to achieve rapid opening of diaphragm valve 20 for treatment of explosive fires, especially fires generated in or near fuel tanks in military vehicles, due to enemy projectile penetration of the vehicle. FIG. 6 is a conceptual representation of the invention. FIGS. 1 through 3 show a practical form of the invention.

Referring in greater detail to FIGS. 1 through 3, there is fragmentarily shown a thick-walled fire suppressant bottle 10 having a depending neck 12 defining a flow discharge opening 14. The bottle is normally oriented in an upright attitude which its central axis 16 generally vertical. During standby periods fire suppressant is confined within bottle 10 by means of an imperforate metal diaphragm 20 suitably mounted in a valve housing 22 below the bottle. The liquid fire suppressant is maintained at a relatively high pressure, e.g., 750 p.s.i., by means of an inert pressurizing gas as explained generally in my earlier U.S. Pat. No. 3,915,237.

Valve housing 22 has a horizontal central slide axis 24 in intersecting relation to bottle axis 16. Liquid suppressant flows downwardly from the bottle through a large port 26 in a hollow piston 28 that is adapted to slide within housing 22 along slide axis 24. In its illustrated FIG. 1 position the piston is retracted leftwardly away from diaphragm 20. The piston is of hollow stepped construction, comprising a first small diameter wall 30, a second large diameter wall 32, and an interconnecting wall 34 that is sometimes hereinafter referred to as a force-application wall. Valve housing 22 has an internal stepped configuration corresponding to the piston dimensions; the housing includes a first relatively small diameter guide surface 36, a second relatively large diameter guide surface 38, and an interconnecting surface 40, sometimes hereinafter referred to as a force-application surface. The left end of the housing is closed by a cap 43.

The annular space between force-application wall 34 and force-application surface 40 constitutes a force chamber 42. Pressurized suppressant can flow through a small orifice 44 into chamber 42, thereby exerting a force that balances the liquid force that would otherwise tend to bias the piston in a rightward direction. A relatively light spring mechanism 46 normally urges the piston leftwardly to its illustrated position retracted away from diaphragm 20. The right edge area of the annular piston is sharpened to a knife edge condition so that when annular chamber 42 is depressurized the piston will move rapidly in a rightward direction to enable knife edge 50 to pierce through diaphragm 20. Knife edge 50 preferably extends for about 320 degrees around the piston axis so that when the diaphragm is pierced a nonsevered flap area of the diaphragm will keep the severed diaphragm attached to the anchored peripheral area of the diaphragm; the severed portion of the diaphragm will deflect and flatten against the interior side surface of exit coupling 52 without being dislodged into the flowing liquid-vapor stream (primarily liquid) and possibly harming humans in the stream path.

Figure 4:
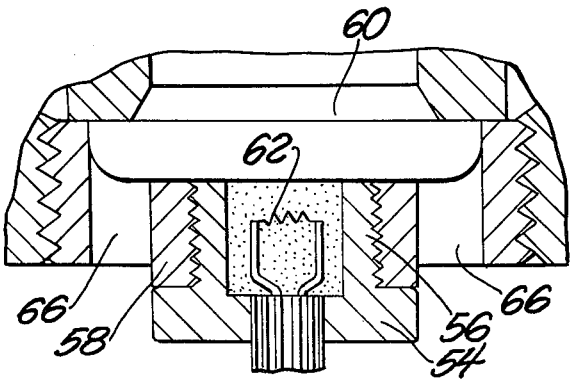
FIG. 4 illustrates a structural detail employed in the FIG. 1 valve.

As noted, piston 28 is moved rightwardly by depressurizing chamber 42. Thus, by removing the leftward fluid force component that had been acting on wall surface 34 the rightwardly-acting fluid forces are enabled to rapidly propel the piston toward diaphragm 20. Spring 46 is a light spring that presents essentially no resistance to the desired piston motion. Depressurizing or venting chamber 42 is accomplished by an electrically-triggered explosive squib 54 (FIG. 1) of generally conventional design. As shown in FIG. 4, the squib includes a small cup element 56 threaded into a holder 58. When a step increase voltage is applied to filament 62 the resultant explosive force is applied to a small metal diaphragm 64 (FIG. 1). As the diaphragm is fragmented the chamber 42 pressure is vented downwardly through the burst diaphragm and vent openings 66 in holder 58; a screen 67 prevents the diaphragm fragments from getting into chamber 42 where they might interfere with rightward motion of piston 28.

The fragments and flame are exhausted along with the chamber 42 fluid into a chamber 68. As best seen in FIG. 3, chamber 68 communicates with two one-way valves 69 that automatically open to expel the pressure fluids. Screens 71 prevent fragments from escaping or otherwise injuring humans in the area. Combined flow area of valves 69 is sufficient to permit very rapid expulsion of the pressure out of chamber 68.

The face area of diaphragm 64 is substantially less than the face area of main diaphragm 20, preferably no greater than one fourth of the diaphragm 20 face area. The cutting force to rupture diaphragm 20 comes from the fluid pressure forces, incident to the stepped piston configuration, not from the squib 54 explosive force. The squib can be a very small size item, much smaller than squibs used to directly generate the knife-actuator forces. In the FIG. 1 design the knife-actuator force is a function of the suppressant pressure (usually on the order of 750 p.s.i.) and the transverse cross sectional area of force chamber 42 normal to piston slide axis 24. Preferably the chamber 42 area is significantly greater than the area of diaphragm 20 exposed to fluid forces. In the FIG. 1 construction the chamber 42 area is about twice the diaphragm 20 area.

One advantage of the illustrated arrangement is that diaphragm 20 and the associated flow pasage can be relatively large for very rapid fluid discharge through outlet coupling 52. In the FIG. 1 design the diaphragm area is substantially as large as bottle discharge opening 14. The diaphragm can be somewhat thicker than conventional, to withstand the greater fluid forces associated with the greater diaphragm area. Thus, because of the relatively high knife-actuator forces produced by the stepped piston configuration, the annular knife will be capable of rapidly severing the diaphragm even though the diaphragm is thicker (stronger) than conventional diaphragms. This is possible even though the explosive squib 54 may be relatively small.

The aforementioned orifice 44 (FIG. 1) is preferably located at a point along the piston surface such that when the piston is in its retracted position the orifice is in close proximity to housing surface 40. As the squib 54 explodes and piston 28 begins its rightward motion orifice 44 is closed by housing surface 36, so that it is unable to feed any fluid into chamber 42. Orifice 44 is preferably quite small, e.g., less than five percent of the area of diaphragm 64. In practice orifice 44 area would be less than one percent of the diaphragm 64 area.

The FIG. 1 valve includes a second means for manually fracturing main diaphragm 20, e.g., when a fire condition fails to trigger the electrical system into action. This second means comprises a small rupturable disc 80 (FIG. 1) sealingly mounted in a straight passage 82 communicating with force chamber 42. A rod 84, having a sharpended end, is arranged to pierce disc 80 and rupture same when an axial force is applied thereto by a movable lanyard arm 85. Arm 85 is swingable on a pivot pin 86 in a plane generally transverse to the plane of the paper in FIG. 1. Remote operation of arm 85 by a cable, not shown, causes the arm to swing around pivot pin 86, as designated by the arrows in FIG. 2. Arm 85 is formed with a central dwell surface 87 having a constant spacing from the pin 86 axis, and two cam end surface areas 89 spaced progressively nearer to the pin 86 axis. While dwell surface 87 is engaged with rod 84 there is no rod motion. As arm 85 is swung to move surface areas 89 progressively along the rod 84 end face the rod is moved generally upwardly to pierce disc 80 and thus vent pressure from chamber 42. The guide for rod 84 may be slotted to conduct pressurized fluid from chamber 42 into chamber 68. The disc 80 thickness (burst pressure rating) is selected so that disc 80 can function as an overpressure safety relief during standby periods; the disc will burst should the pressure in chambers 31 and 42 exceed a predetermined safe value.

Cables, not shown, may be connected to the exposed end of arm 85 to permit remote actuation of the arm by members of the crew in the vehicle in which the fire suppressant-system is installed. Tension springs 90 (FIG. 2) normally retain arm 85 in its inactive position.

One advantage of the FIG. 2 mechanism is the fact that arm 85 can be swung in either direction to effect movement of rod 84. Actuator cables can be extended in different directions to different locations in the vehicle. Another advantageous feature is the large dwell space achieved by central cam surface 87; the arm can vibrate a considerable amount without accidental actuation of rod 84. The large dwell space 87 also compensates somewhat for tolerance problems associated with the actuator cables; the cable tautness in the standby mode can vary somewhat without inadvertent actuation of arm 85 and rod 84. To provide positive assurance against rod 84 actuation a set screw mechanism 91 (FIG. 1) may be provided in one wall of housing 22; inward adjustment of the screw locks arm 85 against swing movement.

Figure 5:
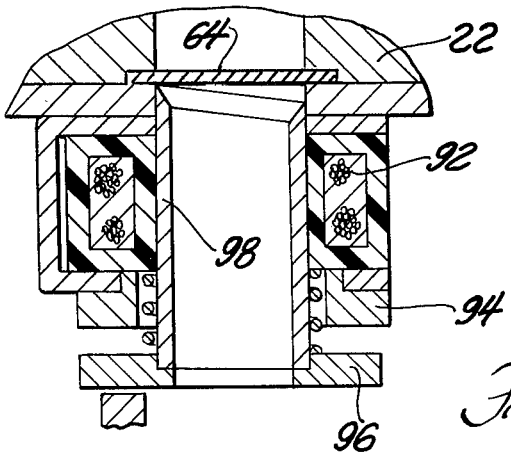
FIG. 5 illustrates an actuator that can be used as an alternate to the actuator shown in FIG. 1.

FIG. 5 illustrates a solenoid actuator that can be used in lieu of the FIG. 1 squib actuator 54. A conventional solenoid winding 92 magnetizes a pole piece 94 to draw an armature 96 upwardly. An annular cutter 98 pierces diaphragm 64 to accomplish the chamber-vent action. The operating force developed by a reasonably sized solenoid is appreciably less than the force generated by an explosive squib (FIG. 4). Therefore cutter 98 and diaphragm 64 in the solenoid valve arrangement have to be relatively small; diaphragm 64 in FIG. 5 would in practice be smaller than diaphragm 64 in FIG. 1. Accordingly, when the solenoid-actuated cutter concept is used to rupture the diaphragm it is necessary to use two assemblies of the type shown in FIG. 5; each assembly would communicate with annular chamber 42. The assemblies would be located at circumferentially spaced points around the chamber 42 periphery.

The valve of FIGS. 1 through 3 is believed to have an advantage as regards leak-free operation during long standby periods, e.g., in excess of one year. Suppressant pressure is contained within the valve by three diaphragms 20, 64 and 80, and two static seals 37 and 39 (FIG. 1). No moving seals are relied on to contain the pressure. Accordingly it is believed that the valve will remain leak-free over prolonged standby periods.

Another advantage of the FIG. 1 valve is the low noise production associated with the relatively small squib 54. Ear-damaging noise should be less compared to possible ear damage encountered with larger conventional explosive squibs use to directly drive the cutter piston. Noise generation is also less with my design due to the location of the squib within the valve, i.e., remote from the discharge opening 52.

A further possible advantage of the FIG. 1 valve is containment of flames associated with squib action. In some conventional squib-actuated valve designs the flame generated by the squib travels through the valve discharge opening toward the fireball in advance of the suppressant. This flame blast is a possible ignition source for flammable fuel or other material in the vehicle. In my design the squib-generated flame is directed into chamber 68, i.e., away from the target fireball.

The FIG. 1 valve is also believed to have certain advantages in regard to rapid-open action. For example, since diaphragm 64 is used only to vent the existing pressure it can be relatively small. A small diameter diaphragm can be relatively thin and still retain the pressure; at the same time the small, thin diaphragm needs only a small explosive squib for rupture action. Overall, the squib-diaphragm 64 system is a fast response system. The stepped piston is also believed to be fast-acting because of the relatively large differential area achievable with ventable chamber 42. Also, when the venting action occurs the pressure in actuator chamber 33 is already at a high value so that the piston can be very rapidly accelerated toward diaphragm 20. The annular cutter 50 can be prepositioned in very close proximity to the diaphragm, without need for a pretravel space to let the cutter accelerate prior to striking the diaphragm. It is also believed that cutter 50 can have a very small angle of incidence to the diaphragm surface, thus permitting the cutting action to occur with a shortened piston stroke. I use the term "angle of incidence" to mean the angle that the cutter 50 profile makes with the diaphragm surface, i.e., the angle shown in FIG. 1. A small incidence angle is possible because of the high actuator forces achieved by the stepped piston; cutter 50 can quickly overcome the diaphragm wall resistance to immediately shear through a substantial portion of the diaphragm circumference. It is not necessary to use a long cutter stroke or high incidence angle cutter.

I wish it to be understood that I do not desire to be limited to the exact details of construction shown and described for obvious modifications will occur to a person skilled in the art.

I claim:

1. In a fire suppressant system comprising a pressurized suppressant container having a discharge opening; a control valve housing located in close adjacency to the container, said housing defining a first relatively small diameter internal guide surface, a second relatively large diameter internal guide surface, and an interconnecting force-application surface; a hollow stepped piston slidably mounted in the valve housing, said piston having a first small diameter wall slidable on the first housing guide surface, a second large diameter wall slidable on the second housing guide surface, and an interconnecting force-application wall facing the housing force-application surface; the space between the housing force-application surface and the piston force-application wall constituting an annular force chamber; port means in the small diameter wall of the piston for enabling pressurized suppressant to flow from the container discharge opening into the hollow piston; an orifice in the small diameter wall of the piston for enabling some of the pressurized suppressant within the piston to flow into the annular force chamber, whereby the piston is normally biased to a retracted position; a diaphragm mounted in the housing adjacent one end of the piston to normally prevent flow of pressurized suppressant out of the space within the piston; said one end of the piston constituting a knife edge effective to cut through the diaphragm when the aforementioned annular force chamber is depressurized; and rapid-acting means for venting suppressant from the annular force chamber to depressurize same, thereby enabling suppressant within the hollow piston to move said piston from its retracted position to a flow-open position in which the knife edge has cut through the diaphragm.

2. The combination of claim 1: said venting means comprising a second diaphragm mounted on the housing in fluid communication with the force chamber to normally prevent escape of the suppressant, and an explosive squib in close proximity to the second diaphragm for rupturing said second diaphragm when a voltage is applied to the squib.

3. The combination of claim 2: said second diaphragm having a face area that is substantially less than the face area of the first diaphragm.

4. The combination of claim 2: said second diaphragm having a face area that is no greater than one fourth the face area of the first diaphragm.

5. The combination of claim 2: the orifice in the piston being located in close proximity to the force-application surface of the control valve housing when the piston is in retracted position, whereby initial movement of the piston toward its flow-open position causes the orifice to be closed by the housing small diameter guide surface; the orifice flow area being less than five percent of the second diaphragm face area.

6. The combination of claim 1: the area of the force chamber normal to the piston slide axis being at least twice the face area of the diaphragm.

7. The combination of claim 1: the container being oriented with the axis of the discharge opening extending vertically; said control valve housing being positioned directly below the container with its guide axis extending horizontally in intersecting relation to the discharge opening axis.

8. The combination of claim 6: said port means defining a flow area that is substantially as large as the flow area of the container discharge opening, whereby suppressant is enabled to flow freely from the container into the hollow piston.

9. The combination of claim 1 and further comprising a second means for venting suppressant from the annular force chamber; said second vent means comprising a rupturable disc exposed to the chamber pressure, a slidable disc-piercer rod, and a manually-movable arm operatively engageable with the rod to move same toward the disc.

10. The combination of claim 9: said manually-movable arm being swingably mounted for movement in a plane generally transverse to the rod axis, said arm having an arcuate cam surface contacting the rod to effect rod movement; the cam surface having a central dwell surface area having a constant spacing from the arm swing axis, and end surface areas spaced varying distances from the arm swing axis, whereby movement of the arm from a central position in either direction causes the rod to pierce the disc.

* * * * *